US010358689B2

(12) United States Patent
Hamada et al.

(10) Patent No.: US 10,358,689 B2
(45) Date of Patent: Jul. 23, 2019

(54) METHOD OF PRODUCING FERRITIC STAINLESS STEEL SHEET

(71) Applicant: NIPPON STEEL & SUMIKIN STAINLESS STEEL CORPORATION, Tokyo (JP)

(72) Inventors: Junichi Hamada, Tokyo (JP); Eiichiro Ishimaru, Tokyo (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 81 days.

(21) Appl. No.: 15/811,383

(22) Filed: Nov. 13, 2017

(65) Prior Publication Data

US 2018/0066335 A1 Mar. 8, 2018

Related U.S. Application Data

(62) Division of application No. 14/765,535, filed as application No. PCT/JP2014/052551 on Feb. 4, 2014, now abandoned.

(30) Foreign Application Priority Data

Feb. 4, 2013 (JP) ..... 2013-019608

(51) Int. Cl.

| | |
|---|---|
| ***C22C 38/00*** | (2006.01) |
| ***C21D 9/46*** | (2006.01) |
| ***C22C 38/38*** | (2006.01) |
| ***C22C 38/58*** | (2006.01) |
| ***C22C 38/18*** | (2006.01) |
| ***C21D 6/00*** | (2006.01) |
| ***C21D 6/02*** | (2006.01) |
| ***C21D 1/84*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/30*** | (2006.01) |
| ***C22C 38/40*** | (2006.01) |
| ***C22C 38/60*** | (2006.01) |

(52) U.S. Cl.

CPC ..... *C21D 9/46* (2013.01); *C21D 1/84* (2013.01); *C21D 6/002* (2013.01); *C21D 6/02* (2013.01); *C21D 8/0205* (2013.01); *C21D 8/0236* (2013.01); *C22C 38/00* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/18* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/38* (2013.01); *C22C 38/40* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C22C 38/60* (2013.01); *C21D 2211/004* (2013.01); *C21D 2211/005* (2013.01)

(58) Field of Classification Search

CPC ..... C22C 38/00; C21D 9/46; C21D 6/002
USPC ..... 148/610
See application file for complete search history.

(56) References Cited

U.S. PATENT DOCUMENTS

| | | | |
|---|---|---|---|
| 2005/0161133 | A1 | 7/2005 | Hamada et al. |
| 2010/0150770 | A1 | 6/2010 | Hiraide et al. |
| 2011/0236248 | A1 | 9/2011 | Hatano et al. |
| 2011/0265920 | A1 | 11/2011 | Hatano et al. |

(Continued)

FOREIGN PATENT DOCUMENTS

| | | | |
|---|---|---|---|
| CN | 1692167 | A | 11/2005 |
| EP | 1 571 227 | A1 | 9/2005 |

(Continued)

OTHER PUBLICATIONS

International Search Report issued in PCT/JP2014/052551 dated Apr. 8, 2014.

(Continued)

*Primary Examiner* — Edward M Johnson
(74) *Attorney, Agent, or Firm* — Birch, Stewart, Kolasch & Birch, LLP

(57) ABSTRACT

Ferritic stainless steel sheet which is excellent in ridging resistance which comprises, by mass %, Cr: 10 to 30%, Sn: 0.005 to 1%, C: 0.001 to 0.1%, N: 0.001 to 0.1%, Si: 0.01 to 3.0%, Mn: 0.01 to 3.0%, P: 0.005 to 0.1%, and S: 0.0001 to 0.01% and has a balance of Fe and unavoidable impurities and which has an X-ray diffraction strength in the {100}<012> orientation from a surface layer to t/4 ("t" is sheet thickness) of 2 or more.

2 Claims, 1 Drawing Sheet

(56) References Cited

U.S. PATENT DOCUMENTS

| | | | |
|---|---|---|---|
| 2013/0017116 | A1 | 1/2013 | Hatano et al. |
| 2013/0306204 | A1 | 11/2013 | Teraoka et al. |
| 2013/0319583 | A1 | 12/2013 | Hatano et al. |
| 2014/0023550 | A1 | 1/2014 | Hamada et al. |
| 2014/0216614 | A1 | 8/2014 | Hatano et al. |

FOREIGN PATENT DOCUMENTS

| | | | |
|---|---|---|---|
| EP | 1 734 143 | A1 | 12/2006 |
| JP | 50-123294 | | 9/1975 |
| JP | 57-38655 | A | 8/1982 |
| JP | 61-19688 | B2 | 5/1986 |
| JP | 61-261460 | A | 11/1986 |
| JP | 09-155407 | A | 6/1997 |
| JP | 10-330887 | A | 12/1998 |
| JP | 11-92872 | A | 4/1999 |
| JP | 2000-169943 | A | 6/2000 |
| JP | 2001-262234 | A | 9/2001 |
| JP | 2006-045613 | A | 2/2006 |
| JP | 61-163216 | A | 7/2006 |
| JP | 2006-233278 | A | 9/2006 |
| JP | 2008-190003 | A | 8/2008 |
| JP | 2009-174036 | A | 8/2009 |
| JP | 2010-31315 | A | 2/2010 |
| JP | 2010-159487 | A | 7/2010 |
| JP | 2012-172161 | A | 9/2012 |
| TW | 201139698 | A1 | 11/2011 |
| WO | WO 2004/053171 | A1 | 6/2004 |
| WO | WO 2012/108479 | A1 | 8/2012 |
| WO | WO 2012/111391 | A1 | 8/2012 |
| WO | WO 2012/133573 | A1 | 10/2012 |
| WO | WO 2012/173272 | A1 | 12/2012 |

OTHER PUBLICATIONS

Advisory Action dated Oct. 20, 2017 in U.S. Appl. No. 14/765,535.
Office Action dated Jul. 10, 2017 in U.S. Appl. No. 14/765,535.
Office Action dated Mar. 24, 2017 in U.S. Appl. No. 14/765,535.

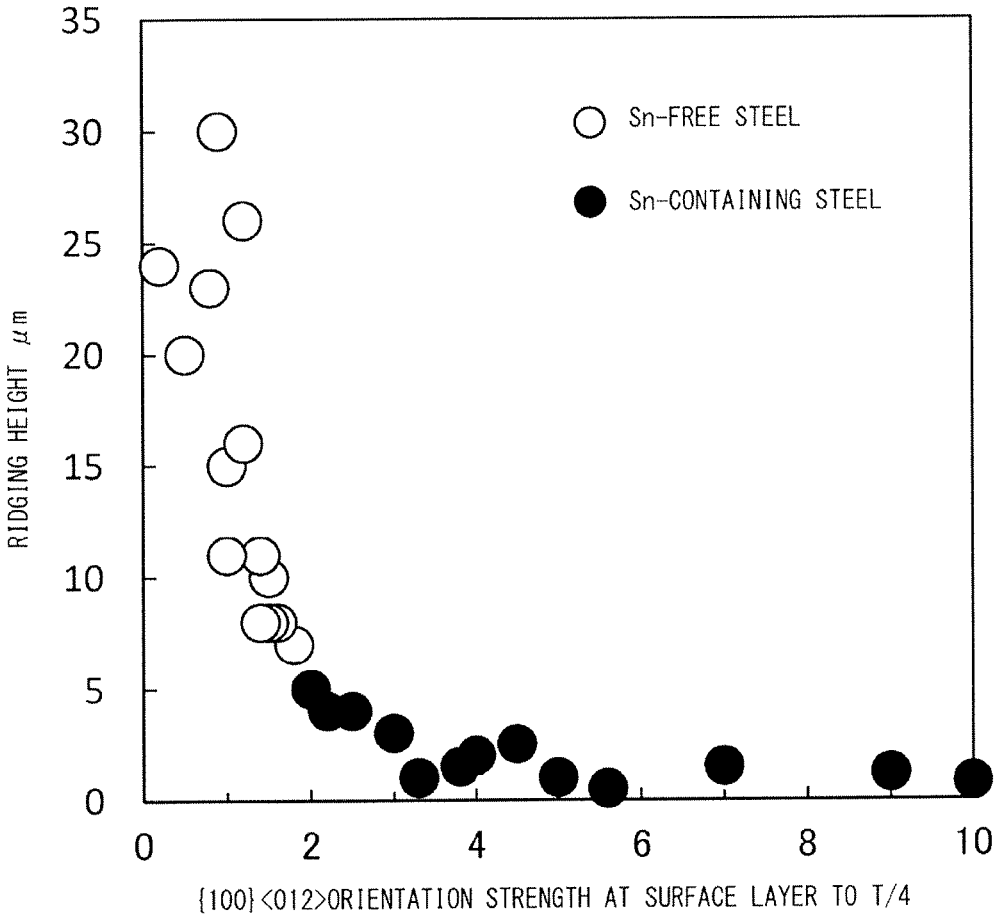
35
30
25
20
15
10
5
0
RIDGING HEIGHT μm
Sn-FREE STEEL
Sn-CONTAINING STEEL
0
2
4
6
8
10
{100}<012>ORIENTATION STRENGTH AT SURFACE LAYER TO T/4

METHOD OF PRODUCING FERRITIC STAINLESS STEEL SHEET

CROSS REFERENCE TO RELATED APPLICATIONS

This application is a Divisional of copending U.S. application Ser. No. 14/765,535 filed on Aug. 3, 2015, which is the National Phase under 35 U.S.C. § 371 of International Application No. PCT/JP2014/052551, filed on Feb. 4, 2014, which claims the benefit under 35 U.S.C. § 119(a) to Japanese Patent Application No. 2013-019608, filed in Japan on Feb. 4, 2013, all of which are hereby expressly incorporated by reference into the present application.

TECHNICAL FIELD

The present invention relates to ferritic stainless steel sheet which is excellent in workability and ridging resistance and a method of production of the same.

BACKGROUND ART

Ferritic stainless steel sheet is excellent in corrosion resistance and heat resistance and is being used for household electrical appliances, transport equipment, building use, and various other fields. However, it is inferior in ductility compared with austenitic stainless steel and suffers from formation of surface relief shapes called "ridging" when worked to shape it. There is therefore the problem of the surface quality and the polishing ability after being worked to shape it being obstructed.

To improve the shapeability, as described in PLT 1, the method is disclosed of reducing the C or N and adding Ti or Nb. By making the steel components high in purity and increasing the {111} crystal orientation, ferritic stainless steel sheet can be improved in the "r-value", an indicator of deep drawability, and improved in shapeability.

Regarding ridging, it is known that ridging occurs due to colonies of crystal grains which have similar crystal orientations remaining at the finished product sheet due to the casting structure or hot rolling structure. Among these, in particular, numerous arts have been disclosed for reducing colonies which have {100} crystal orientations. As representative arts, there are the electromagnetic stirring, inoculation of solidification nuclei, low temperature casting, etc. which are shown in PLT 2 etc. as techniques for making the solidified structure equiaxial. Further, limits on the hot rolling conditions, annealing conditions, and colony size in finished product sheet are known from PLTs 3 to 5 etc.

In the above way, improving the r-value and reducing the ridging in conventional ferritic stainless steel sheet by adjusting the components and establishing suitable production conditions have been disclosed. In particular, for ridging, a level enabling it to be rendered completely harmless has not yet been reached. It is necessary to control the uneven structure and texture in the direction of sheet thickness and to further improve the surface quality.

On the other hand, PLTs 6,7, and 8 disclose patents relating to Sn-containing ferritic stainless steel. PLT 7 discloses art relating to ferritic stainless steel which is excellent in corrosion resistance and workability and shows, relating to workability, art for giving Sn-containing steel a 0.2% yield strength of 300 MPa or less and elongation at break of 30% or more. However, with just the above 0.2% yield strength or elongation at break, steel which is sufficiently satisfactory in deep drawability and ridging resistance cannot be obtained. Issues remain in workability.

CITATIONS LIST

Patent Literature

PLT 1: Japanese Patent Publication No. 61-261460A
PLT 2: Japanese Patent Application No. 50-123294
PLT 3: Japanese Patent Publication No. 61-19688B2
PLT 4: Japanese Patent Publication No. 57-38655B2
PLT 5: Japanese Patent Publication No. 10-330887A
PLT 6: Japanese Patent Publication No. 2008-190003A
PLT 7: Japanese Patent Publication No. 2009-174036A
PLT 8: Japanese Patent Publication No. 2010-159487A

SUMMARY OF INVENTION

Technical Problem

An object of the present invention is to solve the problems in the existing art and provide ferritic stainless steel sheet which is excellent in workability and which has little occurrence of ridging and a method of production of the same.

Solution to Problem

To solve this problem, the inventors engaged in detailed studies relating to the workability and ridging resistance of ferritic stainless steel sheet, the steel composition, the formation of texture in the production process, and furthermore the mechanism of occurrence of ridging.

As a result, they discovered that by forming a structure with a specific crystal orientation inside of the steel sheet, it is possible to produce ferritic stainless steel sheet which is excellent in shapeability such as deep drawability and ridging resistance.

The gist of the present invention to solve the above problem is as follows:

(1) A ferritic stainless steel sheet excellent in workability comprising, by mass %, Cr: 10 to 30%, Sn: 0.005 to 1%, C: 0.001 to 0.1%, N: 0.001 to 0.1%, Si: 0.01 to 3.0%, Mn: 0.01 to 3.0%, P: 0.005 to 0.1%, S: 0.0001 to 0.01% and a balance of Fe and unavoidable impurities, wherein an X-ray diffraction strength in the {100}<012> orientation from a surface layer of the steel sheet to t/4 is 2 or more, wherein "t" represents the sheet thickness.

(2) The ferritic stainless steel sheet excellent in workability according to (1) further comprising, by mass %, one or more of Ti: 0.005 to 0.5%, Nb: 0.005 to 0.5%, Zr: 0.005 to 0.5%, V: 0.01 to 0.5%, Ni: 0.01 to 1%, Mo: 0.1 to 3.0%, W: 0.1 to 3.0%, Cu: 0.1 to 3.0%, B: 0.0003 to 0.0100%, Al: 0.01 to 1.0%, Ca: 0.0001 to 0.003%, Mg: 0.0001 to 0.005%, Co: 0.001 to 0.5%, Sb: 0.005 to 0.3%, REM: 0.001 to 0.2%, and Ga: 0.0002 to 0.3% or less.

(3) A method of producing ferritic stainless steel sheet excellent in workability according to (1) or (2), the method comprising the steps of: heating a hot rolled steel sheet to 850° C. during annealing the steel sheet; cooling the steel sheet down to 500° C. by a cooling speed of 50° C./sec or less; and cold rolling the steel sheet using rolls of a diameter of 150 mm or less by a reduction rate of 60% or more.

Advantageous Effects of Invention

As clear from the above explanation, according to the present invention, it is possible to efficiently provide ferritic stainless steel sheet which is particularly excellent in ridging resistance without requiring any special new facilities.

BRIEF DESCRIPTION OF DRAWINGS

FIG. 1 is a view which shows a relationship between a {100}<012> orientation strength at a surface layer of cold rolled annealed sheet down to t/4 and a ridging height.

DESCRIPTION OF EMBODIMENTS

Below, the reasons for limitation in the present invention will be explained. Cr has to be added in 10% or more in order to secure corrosion resistance, high temperature strength, and oxidation resistance, but 30% or more addition causes deterioration of toughness and thereby poor manufacturability and also deterioration of quality. Accordingly, the range of Cr was made 10 to 30%. Furthermore, from the viewpoint of costs and corrosion resistance, 13.0 to 25.0% is desirable. Note that, if considering the manufacturability and high temperature ductility, 13.0 to 18.0% is desirable. 15.5 to 16.5% is also possible.

Sn is an extremely important element in the present invention for suppressing ridging by control of crystal orientation and is added in 0.005 to 1%. Sn is an element which easily segregates at the grain boundaries. Grain boundary segregation occurs in the process of annealing hot rolled sheet in the production process. The inventors discovered that if cold rolling sheet and applying heat treatment for recrystallization, nuclei of a characteristic crystal orientation which is effective for reducing ridging easily form from the Sn segregated parts.

In general, as the recrystallization orientation after cold rolling, at the middle part of sheet thickness, the {111} crystal orientation mainly grows. In addition, if the {100} orientation, which is smaller in plastic deformation ability and more liable to result in reduction of sheet thickness than the {111}, is present in colonies, surface relief shapes will be formed after working and the ridging resistance will become poor. On the other hand, from the surface layer to near the t/4 part, the {111} crystal orientation becomes weak. In this research, it was discovered that when adding Sn, the {100}<012> orientation easily forms from the surface layer to near t/4 at the stage of annealing after cold rolling. At the time of cold rolling, a large shear strain acts on the inside of the material at the surface layer to the t/4 part. It is believed that at the time of annealing the hot rolled sheet, if Sn segregates at the grain boundaries, that shear strain remarkably acts on the segregated parts and that at the subsequent heat treatment process, the specific crystal orientation of {100}<012> more easily forms nuclei.

As explained later, it is guessed that if the {100}<012> orientation is formed from the surface layer to the t/4 part, an action of reducing relief shapes which form due to the plastic anisotropy between colonies at the center layer part of sheet thickness occurs near the surface layer part, so surface relief shapes become harder to form. Grain boundary segregation of Sn and formation of the {100}<012> orientation occur with 0.005% or more addition, so the lower limit was made 0.005%. On the other hand, excessive addition results in fracture and other problems in the production process, so the upper limit was made 1%. Further, from the viewpoint of deterioration of the weldability, the upper limit is desirably made 0.5%. Furthermore, from the viewpoint of corrosion resistance and toughness, 0.03 to 0.5% is desirable. More desirable is 0.1 to 0.3%, while optimal is 0.15 to 0.25%.

In the present invention, in the above way, due to the addition of Sn, in the production process, Sn segregates at the grain boundaries. Utilizing this, after cold rolling and annealing, minor crystal orientation {100}<012> which usually does not occur much at all is caused from the sheet thickness surface layer to near the t/4 part and ridging is reduced.

FIG. 1 shows the relationship between the {100}<012> orientation strength from the surface layer to near t/4 and the ridging resistance. Here, 17% Cr steel (0.005% C-0.1% Si—0.1% Mn-0.01% P-0.0001% S-0.1% Ti-0.18% Nb-0.007% N) free of Sn (<0.001%) and containing 0.2% Sn was vacuum melted, hot rolled, cold rolled, and annealed to obtain cold rolled annealed sheet. The {100}<012> orientation X-ray diffraction strength was found by using an X-ray diffraction apparatus (made by Rigaku Corporation) and using Mo-Kα-rays to obtain the (200), (310), and (211) pole figures of the region from the surface layer to near t/4 (measurement surface brought out by combination of mechanical polishing and electrolytic polishing) and using spherical harmonics to obtain the 3D crystal orientation density function from these and find the crystal orientation strength (ratio of strength with random sample).

Regarding the ridging resistance, a JIS No. 5 tensile test piece was taken from the cold rolled annealing sheet, given 16% strain in parallel to the rolling direction, and evaluated for ridging resistance by the ridging height (maximum distance of relief shapes occurring in direction perpendicular to rolling direction) and visual examination. The ranks in the visual examination were as follows:

A: Ridging not observed (ridging height 5 μm or less),

B: Ridging observed somewhat visually (ridging height 10 μm or less),

C: Ridging observed clearly visually (ridging height 20 μm),

D: Ridging observed clearly visually and formation of relief shapes understood when touching surface by finger (ridging height over 30 μm)

From FIG. 1, by making the X-ray diffraction strength in the {100}<012> orientation from the surface layer to t/4 ("t" is sheet thickness) two times or more, the ridging can become the A level and can be reduced to a level not posing a problem in practice. Therefore, the lower limit of the {100}<012> orientation strength was made 2 or more. That crystal orientation was obtained by grain boundary segregation of Sn and imparting shear strain in the above way. To make it formed more remarkably, it is necessary to increase the amount of grain boundary segregation of Sn or strengthen the shear strain. These sometimes are accompanied with issues in manufacturability and also lead to a fall in the r-value, so as a desirable range, the upper limit was made 10 or less.

C causes the workability, corrosion resistance, and oxidation resistance to deteriorate, so the content should be as small as possible, therefore the upper limit was made 0.1%. However, excessive reduction leads to an increase in the refining costs, so the lower limit was made 0.001%. Furthermore, if considering the manufacturing costs, corrosion resistance, and workability, 0.002 to 0.05% is desirable. Furthermore, from the viewpoint of the corrosion resistance, making it 0.002 to 0.009% is desirable.

N as well, like C, causes the workability, corrosion resistance, and oxidation resistance to deteriorate, so the content should be as small as possible, therefore the upper limit was made 0.1%. However, excessive reduction leads to an increase in the refining costs, so the lower limit was made 0.001%. Furthermore, if considering the manufacturing costs, corrosion resistance, and workability, 0.002 to 0.05% is desirable. Furthermore, from the viewpoint of the corrosion resistance, making it 0.002 to 0.05% is desirable.

Si is sometimes added as a deoxidizing element and also is an element which improves the oxidation resistance and high temperature strength. 0.01% or more is added. Excessive addition lowers the ordinary temperature ductility to degrade the workability, so the upper limit was made 3.0%. Furthermore, if considering the material quality and the oxidation characteristic, 0.05 to 1.0% is desirable. Furthermore desirable is 0.1 to 0.7%.

Mn forms $MnCr_2O_4$ or MnO at a high temperature and improves the scale adhesion. This effect is manifested at 0.01% or more, so the lower limit was made 0.01%. On the other hand, excessive addition causes a drop in corrosion resistance and ductility, so the upper limit was made 3.0%. Furthermore, if considering workability and manufacturability, 0.05 to 1.5% is desirable. More desirably it is 0.1 to 1.0%.

P is a solution strengthening element in the same way as Si. Due to material quality, the smaller the content the better. The upper limit was made 0.1%. However, excessive reduction leads to an increase in the refining costs, so the lower limit was made 0.005%. Furthermore, if considering the manufacturing costs and oxidation resistance, 0.01 to 0.025% is desirable.

S should be as small in content as possible from the viewpoint of the material quality, corrosion resistance, and oxidation resistance, so the upper limit was made 0.01%. In particular, excessive addition forms compounds with Ti etc. and overly promotes the recrystallization and grain growth in the hot rolled annealed sheet to thereby degrade the r-value. However, excessive reduction leads to an increase in the refining costs, so the lower limit was made 0.0001%. Furthermore, if considering the manufacturing costs and corrosion resistance, 0.0010 to 0.0050% is desirable.

Ti is an element which is added for bonding with C, N, and S to further improve the corrosion resistance, grain boundary corrosion resistance, and deep drawability. In particular, the growth of the {111} crystal orientation for improving the r-value is manifested by 0.005% or more of addition, so the lower limit was made 0.005%. By 0.5% or more of addition, the toughness, secondary workability, and r-value deteriorate, so the upper limit was made 0.5%. Furthermore, if considering the manufacturing costs, surface flaws, and scale peeling, 0.05 to 0.2% is desirable.

Nb is an element which is added for improving the high temperature strength and high temperature fatigue characteristic by solution strengthening and precipitation strengthening. Further, it fixes C and N as carbonitrides, causes growth of the recrystallized texture of the finished product sheet, forms intermetallic compounds of Fe and Nb called "Laves phases", has an effect on the formation of the recrystallized texture by its volume rate and size, and contributes to improvement of the r-value. These actions are manifested at 0.005% or more, so the lower limit was made 0.005%. On the other hand, excessive addition gives rise to hardening and leads to a drop in ordinary temperature ductility and r-value, so the upper limit was made 0.5%. Furthermore, if considering the costs and manufacturability, 0.1 to 0.3% is desirable.

Zr is an element which improves the oxidation resistance and is added in accordance with need. This action is manifested at 0.005% or more, so the lower limit was made 0.005%. However, 0.5% or more of addition causes the toughness and pickling ability and other aspects of manufacturability to become remarkably degraded. In addition, compounds of Zr with carbon and nitrogen become coarser to make the hot rolled annealed sheet structure coarser and lower the r-value, so the upper limit was made 0.5%. Furthermore, if considering the manufacturing costs, 0.05 to 0.20% is desirable.

V is an element which bonds with C and N to further improve the corrosion resistance, grain boundary corrosion resistance, and deep drawability. In particular, growth of the {111} crystal orientation for improving the r-value is manifested by 0.01% or more addition, so the lower limit was made 0.01%. On the other hand, by 0.5% or more of addition, the toughness and the secondary workability become degraded, so the upper limit was made 0.5%. Furthermore, if considering the manufacturing costs and surface defects, 0.05 to 0.3% is desirable.

Ni is an element which improves the toughness and corrosion resistance, so is added in accordance with need. The contribution to toughness is manifested at 0.01% or more, so the lower limit was made 0.01%. On the other hand, over 1% addition causes austenite phases to be formed and the r-value to fall, so the upper limit was made 1%. Furthermore, if considering the costs, 0.05 to 0.5% is desirable. Further, if considering the viewpoint of the crevice corrosion as well, 0.2 to 0.5% is more desirable.

Mo improves the corrosion resistance and causes an improvement of the high temperature strength due to the solid solution Mo. This effect is manifested at 0.1% or more, so the lower limit was made 0.1%. However, excessive addition causes deterioration of the toughness and a drop in the elongation. Further, the Laves phases become overly formed, the {011} oriented grains are easily formed, and a drop in the r-value is caused. In addition, with over 3.0% addition, the oxidation resistance is degraded, so the upper limit was made 3.0%. Furthermore, if considering the manufacturing costs and manufacturability, 0.1 to 2.0% is desirable.

W, in the same way as Mo, improves the corrosion resistance and causes an improvement of the high temperature strength due to the solid solution Mo. This effect is manifested at 0.1% or more, so the lower limit was made 0.1%. However, excessive addition causes a deterioration of toughness and a drop in elongation. Further, the Laves phases are overly formed, the {011} oriented grains become easily formed, and a drop in the r-value is caused. In addition, with over 3.0% addition, the oxidation resistance is degraded, so the upper limit was made 3.0%. Furthermore, if considering the manufacturing costs and manufacturability, 0.1 to 2.0% is desirable.

Cu is an element which causes an improvement of the rust resistance and improves the high temperature strength, particularly in the medium temperature region, by precipitation of ε-Cu. The effect is manifested with 0.1% or more addition, so the lower limit was made 0.1%. On the other hand, with 3.0% or more addition, deterioration of toughness and an extreme drop in the elongation are caused. In addition, ε-Cu precipitates in the hot rolling process whereby {011} oriented grains are formed and the r-value falls, so the upper limit was made 3.0%. Furthermore, from the viewpoint of the oxidation resistance and manufacturability and suppression of rust flow in a wet/dry cycle corrosive environment, 0.2 to 1.5% is desirable. If considering the costs, 0.2 to 0.5% is good.

B is an element which improves the secondary workability. This effect is manifested at 0.0003% or more, so the lower limit was made 0.0003%. By over 0.0100% addition, $Cr_2B$ and other B compounds are formed and the grain boundary corrosion and fatigue characteristics are made worse. In addition, this causes an increase in the {011} oriented grains and lowers the r-value, so the upper limit was made 0.0100%. Furthermore, if considering the weldability and manufacturability, 0.0003 to 0.0020% is desirable.

Al is sometimes added as a deoxidizing element and also improves the high temperature strength and oxidation resistance. This action is manifested from 0.01%, so the lower limit was made 0.01%. Further, 1.0% or more of addition causes a drop in the elongation and deterioration of the weldability and surface quality. In addition, Al oxides promote the formation of {011} oriented grains and lead to a drop in the r-value, so the upper limit was made 1.0%. Furthermore, if considering the refining costs, 0.02 to 0.15% is desirable.

Ca is sometimes added to immobilize the S. This effect is manifested at 0.0001% or more, so the lower limit was made 0.0001%. On the other hand, excessive addition causes the corrosion resistance to degrade, so the upper limit was made 0.003%. Furthermore, if considering the manufacturability and corrosion resistance, 0.0005 to 0.002% is desirable.

Mg forms Mg oxides together with Al in molten steel to act as a deoxidizing agent. In addition, the finely crystallized Mg oxides form nuclei for fine precipitation of Nb- and Ti-based precipitates. If these finely precipitate in the hot rolling process, in the hot rolling process and hot rolled sheet annealing process, the fine precipitates form recrystallization nuclei whereby an extremely fine recrystallized structure is obtained. This contributes to formation of texture. This action is manifested from 0.0001%, so the lower limit was made 0.0001%. However, excessive addition causes degradation of the oxidation resistance and a drop in the weldability etc., so the upper limit was made 0.005%. Furthermore, if considering the refining costs, 0.0003 to 0.002% is desirable.

Co is an element which improves the high temperature strength. In accordance with need, 0.001% or more is added. However, excessive addition causes the workability to degrade, so the upper limit was made 0.5%. Furthermore, if considering the manufacturing costs, 0.05 to 0.3% is desirable.

Sb is effective for improving the corrosion resistance and may be added in 0.3% or more in accordance with need. In particular, from the viewpoint of the crevice corrosion, the lower limit is made 0.005. Furthermore, from the viewpoint of the manufacturability and costs, 0.01% or more is preferable.

An REM is effective for improving the oxidation resistance and is added in accordance with need. The lower limit is made 0.001%. Further, even if over 0.20% is added, the effect becomes saturated and the corrosion resistance falls due to the formation of grains of REM, so the upper limit is made 0.2%. If considering the workability of the finished product and the manufacturing costs, 0.002% to 0.05% is preferable. An "REM (rare earth metal)", according to the general definition, indicates the two elements of scandium (Sc) and yttrium (Y) and the 15 elements from lanthanum (La) to lutetium (Lu) (lanthanides) overall. REMs may be added alone or may be mixtures.

Ga improves the corrosion resistance and suppresses hydrogen embrittlement, so 0.3% or less may be added. From the viewpoint of forming sulfides or hydrides, the lower limit is made 0.0002%. Furthermore, from the viewpoint of the manufacturability and costs, 0.0020% or more is preferable.

The rest of the components are not particularly defined in the present invention, but in the present invention, Ta, Bi, etc. may be added in accordance with need. Note that, As, Pb, and other general harmful elements and impurities are preferably reduced as much as possible.

In the present invention, in addition to the above texture and chemical composition, the inventors also studied the method of production and learned that by controlling the hot rolled sheet annealing conditions and the cold rolling conditions, the distribution of crystal orientations can be controlled and excellent workability can be obtained.

The slab is hot rolled, then in general the hot rolled sheet is annealed to obtain a recrystallized structure. In the present invention, in addition to this, to reduce the ridging, at this step, segregation of Sn at the crystal grain boundaries is promoted. To obtain a recrystallized structure by annealing the hot rolled sheet, the material is heated to a 850° C. or more temperature, but at the cooling stage, the cooling speed down to 500° C. is made 50° C./sec or less to promote grain boundary segregation during this. If the heating temperature is less than 850° C., a recrystallized structure cannot be obtained and a hot rolled orientation causing a drop in the band structure of the hot rolling or r-value remains, so the lower limit was made 850° C. On the other hand, excessive increase in temperature causes crystal grain coarsening, so an upper limit of 1100° C. is desirable. If the objective is to obtain a recrystallized structure by annealing the hot rolled sheet, the upper limit value may be 1000° C. or less, more preferably the upper limit may be less than 900° C.

Regarding the cooling speed, to make Sn sufficiently segregate, it is made 50° C./sec or less, but if considering maintaining the uniformity of the sheet shape, less than 15° C./sec is preferable. From the viewpoint of promoting grain boundary segregation of Sn as well, less than 15° C./sec is preferable. On the other hand, excessively slow cooling lowers the manufacturability and also leads to a drop in the toughness of the hot rolled annealed sheet, so 5° C./sec or more is desirable. Further, for the reason of preventing a drop in toughness or deterioration of pickling ability due to precipitation of fine carbonitrides, over 10° C./sec is desirable. In the present invention, over 10° C./sec and less than 15° C./sec is desirable.

In the cold rolling after annealing the hot rolled sheet, the sheet is rolled down to the predetermined sheet thickness. At this time, rolls of a diameter of 150 mm or less are used and the reduction rate is made 60% or more. This is so as to give a sufficient shear strain to the Sn segregated part from the surface layer to the t/4 part. However, if the roll diameter is too small, the sheet shape becomes poor, so the lower limit of the roll diameter is desirably made 30 mm. Further, excessive increase of the reduction rate leads to a drop in the r-value, so the upper limit is desirably 95%. Furthermore, if considering the productivity and workability, the cold rolling roll diameter is desirably 30 to 100 mm and the reduction rate is desirably 75 to 90%.

EXAMPLES

Steels of the chemical compositions which are shown in Table 1 were smelted to produce slabs. The slabs were hot rolled to obtain 4.0 mm thick hot rolled sheets. After that, the hot rolled sheets were treated by continuous annealing, then were pickled, cold rolled down to 0.8 mm thickness, continuously annealed-pickled, then temper rolled (elongation rate 1.0%) to obtain the finished product sheets. The hot rolling conditions were a slab heating temperature of 1100 to 1250° C., a final temperature of 700 to 950° C., and a coiling temperature of 500° C. or less. Regarding the heating temperature in the annealing of the hot rolled sheet temperature, in accordance with the steel components, the annealing temperature was made 850 to 1100° C. The cooling speed was made 11° C./sec. In the cold rolling, 00 mm rolls were used for rolling by a reduction rate of 80%. The annealing of the cold rolled sheet was performed at 800 to 1000° C. to give a recrystallized structure in accordance with the steel components.

TABLE 1

| | Steel No. | C | N | Si | Mn | P | S | Cr | Sn | Ti | Nb | Zr | V | Ni | Mo |
|---|---|---|---|---|---|---|---|---|---|---|---|---|---|---|---|
| Inv. ex. | A1 | 0.005 | 0.010 | 0.11 | 0.11 | 0.020 | 0.0017 | 14.4 | 0.11 | 0.08 | 0.12 | — | — | — | — |
| | A2 | 0.004 | 0.010 | 0.10 | 0.12 | 0.023 | 0.0008 | 16.4 | 0.32 | 0.09 | 0.18 | — | — | — | — |
| | A3 | 0.006 | 0.010 | 0.10 | 0.10 | 0.020 | 0.0040 | 17.4 | 0.19 | 0.09 | 0.12 | — | — | 0.28 | — |
| | A4 | 0.004 | 0.012 | 0.06 | 0.10 | 0.015 | 0.0025 | 17.3 | 0.21 | 0.07 | 0.12 | — | — | 0.27 | 1.5 |
| | A5 | 0.010 | 0.015 | 0.90 | 0.33 | 0.010 | 0.0005 | 13.5 | 0.05 | — | 0.45 | — | | — | — |
| | A6 | 0.015 | 0.020 | 0.30 | 0.21 | 0.033 | 0.0015 | 16.2 | 0.11 | 0.15 | — | — | — | — | — |
| | A7 | 0.030 | 0.040 | 0.30 | 0.50 | 0.030 | 0.0052 | 16.3 | 0.03 | — | — | — | — | — | — |
| | A8 | 0.020 | 0.018 | 0.40 | 0.20 | 0.018 | 0.0018 | 10.9 | 0.09 | 0.16 | — | — | — | — | — |
| | A9 | 0.006 | 0.009 | 0.40 | 0.31 | 0.030 | 0.0007 | 17.2 | 0.15 | 0.06 | 0.32 | — | — | — | 0.3 |
| | A10 | 0.012 | 0.016 | 0.23 | 0.91 | 0.042 | 0.0007 | 17.9 | 0.08 | 0.09 | 0.45 | — | | — | 1.8 |
| | A11 | 0.019 | 0.014 | 0.19 | 0.11 | 0.030 | 0.0008 | 18.8 | 0.06 | — | 0.35 | — | — | — | 1.9 |
| | A12 | 0.008 | 0.006 | 0.23 | 0.09 | 0.010 | 0.0031 | 18.1 | 0.03 | — | 0.34 | — | 0.11 | — | 1.7 |
| | A13 | 0.005 | 0.023 | 0.15 | 0.15 | 0.026 | 0.0025 | 20.1 | 0.04 | — | 0.25 | — | — | — | — |
| | A14 | 0.028 | 0.035 | 0.36 | 0.45 | 0.036 | 0.0045 | 14.5 | 0.12 | — | — | — | 0.16 | 0.15 | — |
| | A15 | 0.006 | 0.009 | 0.56 | 0.32 | 0.035 | 0.0015 | 14.1 | 0.09 | 0.25 | — | — | — | — | — |
| | A16 | 0.016 | 0.019 | 0.35 | 0.12 | 0.043 | 0.0029 | 12.5 | 0.28 | — | 0.11 | 0.15 | — | — | — |
| | A17 | 0.013 | 0.012 | 0.15 | 0.25 | 0.026 | 0.0024 | 17.6 | 0.07 | — | 0.24 | — | — | — | 1.8 |
| | A18 | 0.006 | 0.012 | 0.12 | 0.12 | 0.023 | 0.0012 | 14.5 | 0.12 | 0.09 | — | — | — | — | — |
| | A19 | 0.010 | 0.009 | 0.85 | 0.15 | 0.021 | 0.0009 | 13.9 | 0.009 | 0.06 | 0.33 | — | — | — | — |
| | A20 | 0.009 | 0.013 | 0.09 | 0.33 | 0.028 | 0.0035 | 16.8 | 0.08 | 0.06 | — | — | | — | — |
| | A21 | 0.035 | 0.033 | 0.38 | 0.56 | 0.042 | 0.0048 | 16.2 | 0.009 | — | — | — | — | — | — |
| | A22 | 0.015 | 0.019 | 0.21 | 0.18 | 0.035 | 0.0015 | 14.5 | 0.10 | — | — | 0.15 | — | — | — |
| | A23 | 0.013 | 0.008 | 0.15 | 0.32 | 0.036 | 0.0026 | 16.3 | 0.23 | — | — | — | 0.23 | — | — |
| | A24 | 0.006 | 0.005 | 0.46 | 0.16 | 0.015 | 0.0016 | 18.5 | 0.008 | 0.11 | — | — | — | — | — |
| | A25 | 0.015 | 0.016 | 0.36 | 0.35 | 0.035 | 0.0036 | 16.5 | 0.013 | — | — | — | — | — | 0.6 |
| | A26 | 0.019 | 0.016 | 0.56 | 0.18 | 0.032 | 0.0026 | 16.6 | 0.013 | — | — | — | — | — | — |
| | A27 | 0.021 | 0.013 | 0.33 | 0.25 | 0.036 | 0.0016 | 16.1 | 0.09 | — | — | — | — | — | — |
| Comp. ex. | B1 | 0.150* | 0.011 | 0.34 | 0.76 | 0.020 | 0.0009 | 16.8 | 0.12 | 0.09 | 0.41 | — | — | — | — |
| | B2 | 0.005 | 0.132* | 0.12 | 0.35 | 0.020 | 0.0009 | 14.3 | 0.23 | 0.13 | — | — | — | — | — |
| | B3 | 0.016 | 0.010 | 3.5* | 0.45 | 0.020 | 0.0012 | 14.5 | 0.15 | — | 0.40 | — | — | — | — |
| | B4 | 0.023 | 0.010 | 0.75 | 3.3* | 0.081 | 0.0002 | 14.5 | 0.09 | 0.12 | 0.38 | — | — | — | — |
| | B5 | 0.007 | 0.013 | 0.95 | 1.30 | 0.13* | 0.0016 | 18.8 | 0.06 | 0.16 | — | — | — | — | — |
| | B6 | 0.013 | 0.005 | 0.22 | 0.98 | 0.040 | 0.0126* | 11.5 | 0.35 | — | 0.31 | — | — | — | — |
| | B7 | 0.004 | 0.013 | 0.36 | 1.20 | 0.020 | 0.0015 | 35.5* | 0.46 | 0.08 | 0.55* | — | — | — | — |
| | B8 | 0.003 | 0.015 | 0.54 | 1.15 | 0.030 | 0.0053 | 14.1 | 0.001* | 0.09 | 0.35 | — | — | — | — |
| | B9 | 0.021 | 0.005 | 0.13 | 0.12 | 0.032 | 0.0035 | 16.2 | 1.32* | 0.19 | | — | — | — | — |
| | B10 | 0.019 | 0.005 | 0.91 | 1.38 | 0.010 | 0.0015 | 19.5 | 0.06 | 0.56* | 0.12 | — | — | — | 1.5 |
| | B11 | 0.006 | 0.031 | 0.13 | 0.64 | 0.040 | 0.0033 | 14.1 | 0.15 | 0.01 | 0.63* | — | — | — | — |
| | B12 | 0.002 | 0.006 | 0.15 | 1.35 | 0.020 | 0.0023 | 16.8 | 0.15 | 0.03 | — | 0.79* | — | — | 0.6 |
| | B13 | 0.033 | 0.017 | 0.11 | 1.05 | 0.030 | 0.0013 | 16.5 | 0.36 | 0.07 | — | — | 0.54* | — | — |
| | B14 | 0.011 | 0.006 | 0.22 | 0.85 | 0.020 | 0.0023 | 16.8 | 0.31 | 0.11 | 0.31 | — | — | 1.2* | 0.6 |
| | B15 | 0.016 | 0.010 | 0.85 | 0.86 | 0.010 | 0.0016 | 14.3 | 0.26 | — | — | — | — | — | 3.3* |
| | B16 | 0.009 | 0.013 | 0.88 | 0.96 | 0.040 | 0.0022 | 14.5 | 0.21 | 0.13 | — | — | — | — | 1.6 |
| | B17 | 0.014 | 0.016 | 0.26 | 0.95 | 0.030 | 0.0007 | 17.3 | 0.19 | — | 0.33 | — | — | — | — |
| | B18 | 0.005 | 0.013 | 0.25 | 1.03 | 0.050 | 0.0011 | 14.1 | 0.13 | 0.07 | — | — | 0.22 | — | 0.7 |
| | B19 | 0.006 | 0.009 | 0.36 | 1.05 | 0.010 | 0.0025 | 16.3 | 0.17 | 0.15 | 0.21 | — | — | — | 1.2 |
| | B20 | 0.022 | 0.015 | 0.14 | 0.08 | 0.015 | 0.0016 | 16.4 | 0.08 | — | 0.16 | — | 0.15 | — | — |
| | B21 | 0.014 | 0.011 | 0.15 | 0.11 | 0.022 | 0.0039 | 11.6 | 0.06 | — | — | — | — | — | — |
| | B22 | 0.005 | 0.006 | 0.19 | 0.16 | 0.029 | 0.0044 | 21.5 | 0.05 | — | 0.18 | — | — | — | — |

| | Steel No. | W | Cu | B | Al | Ca | Mg | Co | Sb | REM | Ga | (100)<012> orientation strength of surface layer to t/4 | Ridging rank | Average r-value of finished product sheet |
|---|---|---|---|---|---|---|---|---|---|---|---|---|---|---|
| Inv. ex. | A1 | — | — | — | — | — | — | — | — | — | — | 2.2 | A | 1.7 |
| | A2 | — | — | — | — | — | — | — | — | — | — | 3.5 | A | 1.6 |
| | A3 | — | 0.25 | 0.0003 | 0.048 | — | — | — | — | — | — | 3.0 | A | 1.8 |
| | A4 | — | 0.20 | — | — | — | — | — | — | — | — | 4.0 | A | 1.8 |
| | A5 | — | — | — | — | — | — | — | — | — | — | 5.0 | A | 1.5 |
| | A6 | — | — | 0.0005 | 0.032 | — | 0.0005 | — | — | — | — | 3.2 | A | 1.9 |
| | A7 | — | — | — | 0.060 | — | — | — | — | — | — | 7.0 | A | 1.5 |
| | A8 | — | — | — | — | — | — | — | — | — | — | 6.2 | A | 1.8 |
| | A9 | — | 1.20 | 0.0008 | 0.110 | — | — | — | — | — | — | 4.5 | A | 1.5 |
| | A10 | — | — | 0.0006 | 0.035 | — | — | — | — | — | — | 2.8 | A | 1.6 |
| | A11 | — | — | — | — | — | — | — | — | — | — | 3.1 | A | 1.7 |
| | A12 | — | — | — | 0.020 | — | — | — | — | — | — | 3.3 | A | 1.8 |
| | A13 | — | — | — | — | 0.0005 | 0.0008 | — | — | — | — | 2.6 | A | 1.6 |
| | A14 | — | — | — | 0.050 | — | — | 0.09 | — | — | — | 4.6 | A | 1.5 |
| | A15 | — | 1.30 | 0.0011 | 0.091 | — | — | — | — | — | — | 2.4 | A | 1.5 |

TABLE 1-continued

| | | | | | | | | | | | | | | |
|---|---|---|---|---|---|---|---|---|---|---|---|---|---|---|
| | A16 | — | 0.50 | — | — | 0.0006 | — | — | — | — | — | 6.6 | A | 1.8 |
| | A17 | 0.50 | 1.30 | 0.0009 | 0.088 | — | — | — | — | — | — | 5.2 | A | 1.6 |
| | A18 | — | — | — | — | — | — | — | 0.05 | — | — | 3.3 | A | 1.6 |
| | A19 | — | — | — | — | — | — | — | — | 0.01 | — | 4.5 | A | 1.7 |
| | A20 | — | — | — | — | — | — | — | — | — | 0.003 | 3.5 | A | 1.8 |
| | A21 | — | — | — | — | — | — | — | — | — | — | 8.5 | A | 1.5 |
| | A22 | — | — | — | — | — | — | — | — | — | — | 2.8 | A | 1.8 |
| | A23 | — | — | — | — | — | — | — | — | — | — | 4.6 | A | 1.8 |
| | A24 | — | — | — | 2.1 | — | — | — | — | — | — | 5.6 | A | 1.6 |
| | A25 | — | — | — | — | — | — | — | — | — | — | 5.8 | A | 1.6 |
| | A26 | 0.9 | — | — | — | — | — | — | — | — | — | 4.9 | A | 1.7 |
| | A27 | — | 0.9 | — | — | — | — | — | — | — | — | 6.8 | A | 1.6 |
| Comp. | B1 | — | — | — | — | — | — | — | | | | 1.5* | B* | 0.5* |
| ex. | B2 | — | — | — | — | — | — | — | | | | 1.2* | B* | 0.6* |
| | B3 | — | — | — | — | — | — | — | | | | 0.3* | D* | 1.2* |
| | B4 | — | — | — | — | — | — | — | | | | 0.4* | C* | 1.4* |
| | B5 | — | — | 0.0009 | — | — | — | — | | | | 1.1* | B* | 1.0* |
| | B6 | — | — | — | — | — | — | — | | | | 1.8* | B* | 1.5 |
| | B7 | — | — | — | — | — | — | — | | | | 0.7* | C* | 1.5 |
| | B8 | — | — | — | 0.042 | — | — | — | | | | 0.5* | C* | 1.6 |
| | B9 | — | — | — | — | — | — | — | | | | 1.6* | B* | 1.2* |
| | B10 | — | — | — | — | — | — | — | | | | 0.1* | D* | 1.4* |
| | B11 | — | — | 0.0003 | — | — | — | — | | | | 0.6* | C* | 1.3* |
| | B12 | — | — | — | — | — | — | — | | | | 1.4* | B* | 1.3* |
| | B13 | — | — | — | 0.036 | — | — | — | | | | 1.5* | B* | 1.5 |
| | B14 | — | — | — | — | — | — | — | | | | 0.6* | C* | 1.2* |
| | B15 | — | — | — | — | — | — | — | | | | 0.3* | D* | 1.3* |
| | B16 | 3.9* | — | — | — | — | — | — | | | | 0.2* | D* | 1.3* |
| | B17 | — | 3.6* | — | — | — | — | — | | | | 0.9* | C* | 1.0* |
| | B18 | — | — | 0.0138* | — | — | — | — | | | | 1.6* | B* | 1.3* |
| | B19 | — | — | 0.0028 | 1.9* | — | — | — | | | | 1.4* | B* | 1.5 |
| | B20 | — | — | — | — | 0.0045* | — | — | | | | 1.0* | C* | 1.5 |
| | B21 | — | — | 0.0016 | — | — | 0.0055* | | | | | 0.8* | D* | 1.6 |
| | B22 | — | — | — | — | — | — | 0.62 * | | | | 0.3* | D* | 1.3* |

*Value outside provision of the present invention or value not satisfying target of present invention The thus obtained finished product sheets were evaluated for ridging resistance and {100}<012> orientation strength by the methods explained above. Further, they were evaluated for the indicator of deep drawability of the r-value. Here, the "r-value" is the average r-value obtained by obtaining JIS No. 13B tensile test pieces from the cold rolled annealed sheet, applying 14.4% strain in the rolling direction, the direction 45° to the rolling direction, and the direction 90° to the rolling direction, and using the formula (1) and formula (2).

$$r=\ln(W_0/W)/\ln(t_0/t) \quad (1)$$

where, $W_0$ is the sheet width before tension, W is the sheet width after tension, $t_0$ is the sheet thickness before tension, and "t" is the sheet thickness after tension.

$$\text{Average } r\text{-value}=(r_0+2r_{45}+r_{90})/4 \quad (2)$$

where, $r_0$ is the r-value in the rolling direction, $r_{45}$ is the r-value in a direction 45° from the rolling direction, $r_{90}$ is the r-value in a direction perpendicular to the rolling direction, and the average r-value need only be 1.5 or more to enable sufficient working.

As clear from Table 1, steels which have the chemical compositions which are defined by the present invention are better in ridging resistance compared with comparative steels and have average r-values of high 1.5 or more. On the other hand, the comparative examples have steel components which are outside the present invention, so they are steels where the finished product sheets have {100}<012> orientation strengths outside of the present invention, ridging resistance of the A rank cannot be obtained, and also the average r-values are less than 1.5.

The characteristics of Invention Example Nos. A1 to A3 when changing the manufacturing conditions in various ways are shown in Table 2. In the case of the comparative examples outside the manufacturing conditions which are prescribed by the present invention, the {100}<012> orientation strength was outside the present invention and the ridging resistance was not the A rank.

TABLE 2

| | | Hot rolled sheet annealing conditions | | Cold rolling conditions | | {100}<012> orientation | | Average | Maximum corrosion depth after repeated |
|---|---|---|---|---|---|---|---|---|---|
| | Steel No. | Heating temperature ° C. | Cooling speed down to 500° C. ° C./sec | Roll diameter mm | Reduction rate | strength at surface layer to t/14 | Ridging rank | r-value of finished product | dry/wet cycle test μm |
| Inv. | A1 | 880 | 14 | 60 | 88 | 2.2 | A | 1.7 | 42 |
| ex. | A1 | 880 | 10 | 100 | 90 | 4.6 | A | 1.7 | 40 |
| | A2 | 930 | 7 | 50 | 80 | 3.3 | A | 1.6 | 33 |
| | A2 | 900 | 5 | 50 | 88 | 3.5 | A | 1.7 | 30 |
| | A3 | 880 | 13 | 60 | 90 | 4.1 | A | 1.8 | 9 |

TABLE 2-continued

| | Steel No. | Hot rolled sheet annealing conditions: Heating temperature ° C. | Hot rolled sheet annealing conditions: Cooling speed down to 500° C. ° C./sec | Cold rolling conditions: Roll diameter mm | Cold rolling conditions: Reduction rate | {100}<012> orientation strength at surface layer to t/14 | Ridging rank | Average r-value of finished product | Maximum corrosion depth after repeated dry/wet cycle test μm |
|---|---|---|---|---|---|---|---|---|---|
| | A3 | 850 | 15 | 100 | 80 | 3.2 | A | 1.7 | 10 |
| | A3 | 890 | 45 | 60 | 75 | 2.5 | A | 1.5 | 14 |
| Comp. | A1 | 800* | 12 | 60 | 88 | 1.9* | B* | 1.4* | 39 |
| ex. | A1 | 750* | 13 | 60 | 90 | 1.5* | B* | 1.3* | 40 |
| | A1 | 930 | 60* | 60 | 80 | 0.9* | C* | 1.5 | 40 |
| | A2 | 900 | 80* | 60 | 88 | 1.1* | B* | 1.5 | 31 |
| | A3 | 900 | 10 | 500* | 90 | 0.8* | C* | 1.7 | 8 |
| | A3 | 900 | 14 | 60 | 55* | 0.2* | D* | 1.1* | 12 |
| | A1 | 950 | 10 | 60 | 58* | 0.3* | D* | 1.0* | 40 |
| | B11 | 900 | 15 | 50 | 80 | 0.2* | D* | 0.9* | 56 |
| | B11 | 850 | 20 | 50 | 88 | 0.5* | C* | 1.0* | 60 |
| | B12 | 950 | 20 | 60 | 88 | 0.5* | C* | 0.5* | 31 |
| | B12 | 950 | 50 | 60 | 88 | 0.5* | C* | 0.6* | 32 |

*Value outside provision of present invention or value not satisfying target of present invention Further, the steels which are shown in Table 2 were evaluated for corrosion resistance by a wet/dry cycle test. The test solution was made nitric acid ions $NO_3^-$: 100 ppm, sulfuric acid ions $SO_4^{2-}$: 10 ppm, chloride ions $Cl^-$: 10 ppm, pH=2.5. An outside diameter 15 mm, height 100 mm, thickness 0.8 mm test tube was filled with the test solution to 10 ml. To this, a 1 t×15×100 mm (entire surface wet polished by #600 emery paper) sample was immersed. This test tube was placed in a 80° C. warm bath. After the elapse of 24 hours, the completely dried sample was lightly washed with distilled water, then a newly washed test tube was again filled with the test solution, and the sample was again immersed in it and held there at 80° C. for 24 hours. This was repeated for a total of 14 cycles.

The steels of the present invention all had good maximum corrosion depths of 50 μm or less. Note that in the case of steels which contain Ni or Cu, the maximum corrosion depths were 15 μm or less, that is, extremely good results were shown in corrosion resistance. Further, Steel No. B8 with a content of Sn outside the range of components of the present invention had a corrosion depth of 50 μm, that is, was inferior in corrosion resistance compared with the invention examples.

Note that, the slab thickness, hot rolled sheet thickness, etc. may be suitably designed. Further, in the cold rolling, the reduction rate, roll roughness, roll diameter, rolling oil, number of rolling passes, rolling speed, rolling temperature, etc. may be suitably selected. The annealing, if necessary, may be bright annealing comprising annealing in hydrogen gas or nitrogen gas or other non-oxidizing atmosphere or may be annealing in the atmosphere. Furthermore, the elongation of the final temper rolling may be suitably adjusted or that rolling omitted. In addition, a tension leveler etc. may be used to correct the shape.

INDUSTRIAL APPLICABILITY

According to the present invention, it becomes possible to produce ferritic stainless steel sheet which is excellent in shapeability such as deep drawability and ridging resistance at a low cost without adding special facilities. As a result, it is possible to supply this as stainless steel sheet materials for household electrical appliances or transport equipment or for building use. The industrial significance is great.

The invention claimed is:

1. A method of producing a ferritic stainless steel sheet excellent in workability comprising, by mass %, Cr: 10 to 30%, Sn: 0.005 to 1%, C: 0.001 to 0.1%, N: 0.001 to 0.1%, Si: 0.01 to 3.0%, Mn: 0.01 to 3.0%, P: 0.005 to 0.1%, S: 0.0001 to 0.01% and a balance of Fe and unavoidable impurities, wherein an X-ray diffraction strength in the {100}<012> orientation from a surface layer of the steel sheet to t/4 is 2 or more, wherein "t" represents the sheet thickness, the method comprising the steps of:

heating a hot rolled steel sheet to 850° C. during annealing the steel sheet;

cooling the steel sheet down to 500° C. by a cooling speed of over 10° C./sec and less than 15° C./sec; and cold rolling the steel sheet using rolls of a diameter of 150 mm or less by a reduction rate of 60% or more.

2. A method of producing a ferritic stainless steel sheet excellent in workability comprising, by mass %, Cr: 10 to 30%, Sn: 0.005 to 1%, C: 0.001 to 0.1%, N: 0.001 to 0.1%, Si: 0.01 to 3.0%, Mn: 0.01 to 3.0%, P: 0.005 to 0.1%, S: 0.0001 to 0.01%, and further comprising, by mass %, one or more of Ti: 0.005 to 0.5%, Nb: 0.005 to 0.5%, Zr: 0.005 to 0.5%, V: 0.01 to 0.5%, Ni: 0.01 to 1%, Mo: 0.1 to 3.0%, W: 0.1 to 3.0%, Cu: 0.1 to 3.0%, B: 0.0003 to 0.0100%, Al: 0.01 to 1.0%, Ca: 0.0001 to 0.003%, Mg: 0.0001 to 0.005%, Co: 0.001 to 0.5%, Sb: 0.005 to 0.3%, REM: 0.001 to 0.2%, and Ga: 0.0002 to 0.3% or less and a balance of Fe and unavoidable impurities, wherein an X-ray diffraction strength in the {100}<012> orientation from a surface layer of the steel sheet to t/4 is 2 or more, wherein "t" represents the sheet thickness, the method comprising the steps of:

heating a hot rolled steel sheet to 850° C. during annealing the steel sheet;

cooling the steel sheet down to 500° C. by a cooling speed of over 10° C./sec and less than 15° C./sec; and cold rolling the steel sheet using rolls of a diameter of 150 mm or less by a reduction rate of 60% or more.

* * * * *